US007243595B2

(12) United States Patent
Petersen et al.

(10) Patent No.: US 7,243,595 B2
(45) Date of Patent: Jul. 17, 2007

(54) PISTON COMPRESSOR

(75) Inventors: Christian Petersen, Hattstedt (DE); Heinz Otto Lassen, Flensburg (DE); Marten Nommensen, Flensburg (DE); Frank Holm Iversen, Padborg (DK)

(73) Assignee: Danfoss Compressors GmbH, Flensburg (DE)

( * ) Notice: Subject to any disclaimer, the term of this patent is extended or adjusted under 35 U.S.C. 154(b) by 352 days.

(21) Appl. No.: 11/000,733

(22) Filed: Dec. 1, 2004

(65) Prior Publication Data

US 2005/0123411 A1 Jun. 9, 2005

(30) Foreign Application Priority Data

Dec. 3, 2003 (DE) ..... 103 56 397

(51) Int. Cl.
*F01B 9/00* (2006.01)

(52) U.S. Cl. ..... 92/140; 92/72

(58) Field of Classification Search ..... 92/72, 92/73, 140; 91/188; 28/888.08
See application file for complete search history.

(56) References Cited

U.S. PATENT DOCUMENTS

| | | | | |
|---|---|---|---|---|
| 1,612,047 | A * | 12/1926 | Owens | 92/140 |
| 2,533,822 | A * | 12/1950 | Lee et al. | 29/888.09 |
| 3,431,796 | A | 10/1966 | Valbjorn | 74/587 |
| 4,300,274 | A | 11/1981 | Papst | 29/156.5 |
| 4,790,730 | A | 12/1988 | Spaeth et al. | 417/413 |
| 4,939,952 | A | 7/1990 | Romer et al. | 74/579 |
| 5,671,655 | A | 9/1997 | Vollrath | 92/128 |
| 2002/0050425 | A1 | 5/2002 | Iversen et al. | 184/6.16 |

FOREIGN PATENT DOCUMENTS

| | | |
|---|---|---|
| DE | 8613993 U | 10/1986 |
| DE | 3802922 | 9/1988 |
| DE | 4418739 | 8/1995 |
| DE | 69213706 | 10/1996 |

* cited by examiner

*Primary Examiner*—Michael Leslie
(74) *Attorney, Agent, or Firm*—McCormick, Paulding & Huber LLP

(57) ABSTRACT

The invention concerns a piston compressor with a piston, which is connected with a crank pin of a drive shaft via a connecting rod having a longitudinal channel. It is endeavored to make the manufacturing of a piston compressor cost effective. For this purpose, it is ensured that the shaft of the connecting rod is made as a sheet metal pipe.

27 Claims, 3 Drawing Sheets

PISTON COMPRESSOR

CROSS-REFERENCE TO RELATED APPLICATIONS

This application is entitled to the benefit of and incorporates by reference essential subject matter disclosed in German Patent Application No. 103 56 397.0 filed on Dec. 3, 2003.

FIELD OF THE INVENTION

The invention concerns a piston compressor with a piston, which is connected with a crank pin of a drive shaft via a connecting rod having a longitudinal channel.

BACKGROUND OF THE INVENTION

Such a piston compressor, which is used for compressing refrigerant gas, is known from DE 100 53 575 C1. Oil flows periodically through the longitudinal channel from the drive shaft via the crank pin to a first bearing, with which the connecting rod is supported on the crank pin, and to a second bearing, with which the connecting rod is supported in the piston.

A further piston compressor is known from U.S. Pat. No. 5,671,655. Here, the connecting rod is fixedly connected with a first connecting rod eye, which again engages with a piston pin. At the other end, the shaft of the connecting rod is connected via an articulated joint with a second connecting rod eye, which can be mounted on the crank pin. This permits a certain movability between the second connecting rod eye and the shaft of the connecting rod. Accordingly, an angle between the movement direction of the piston and the longitudinal axis of the drive shaft is no longer required to be exactly 90°.

It is an object of the present invention to improve upon or overcome the problems associated with the prior art.

SUMMARY OF THE INVENTION

The present invention is based on the task of manufacturing a piston compressor in an inexpensive manner.

The invention solves this problem in that the shaft of the connecting rod is made as a sheet metal pipe.

With this embodiment, the manufacturing of the connecting rod will be relatively inexpensive. Firstly, a relatively cheap material can be used, namely sheet metal pipe. Secondly, the manufacturing process also takes place in a cost-effective manner. It is not required to manufacture a casting, for which a more or less complicated casting mould is required. On the contrary, the shaft of the connecting rod can be drawn or otherwise shaped of sheet metal. Such a sheet metal shaping is known from many areas of the technique. It can be made in a relatively inexpensive manner. Further, this embodiment has the advantage that the connecting rod can be made with a relatively low weight. Accordingly, only smaller masses have to be accelerated during a stroke of the piston. This keeps the risk of vibrations small, which could be conveyed to the outside. Further, also the balancing weights can be selected with a smaller mass, so that the energy consumption during operation of the piston compressor can be reduced. It is relatively easy to adapt the connecting rod to different compressor sizes, as different lengths of pipes are used.

Connecting rods made of sheet metal are known per se. Thus, DE 38 01 802 shows a connecting rod, which is made of a sheet metal shaped product, having at both ends deep-drawn cylinder fittings, into which are pressed bushes of bearing metal. With such a connecting rod, however, no oil can be transferred from the crank pin to the piston.

Preferably, the drive pin has a bearing bush, which has, at least in sections, a spherical outer surface. Thus, the bearing bush no longer has a cylindrical shape. Accordingly, the connecting rod can be offset by a small angle in relation to the bearing bush. Accordingly, the movement direction of the piston and the axis direction of the drive shaft no longer have to enclose an angle of exactly 90°. This reduces the demands on the accuracy during manufacturing and thus keeps the costs low.

It is preferred that the shaft is connected with an at least partially spherical bearing shell, which surrounds the bearing bush. Thus, the bearing shell is adapted to the spherical bearing bush. This does not necessarily mean that the bearing shell and the bearing bush have to have the same radius. The radius of the bearing shell can also be slightly larger than the radius of the bearing bush. Thus, also with small angle deviations, the same or approximately the same bearing properties will be achieved, that is, a sufficiently large bearing surface is available between the connecting rod and the crank pin.

Preferably, the shaft is welded onto the bearing shell. Thus, the bearing shell on the one hand and the shaft of the connecting rod on the other hand can be made as separate parts. This again simplifies the manufacturing. The shaft can simply be cut off from a pipe-shaped semi-finished product. The bearing shell can also be made of sheet metal, for example by deep-drawing. Only at a relatively late stage of the manufacturing the bearing shell and the shaft are joined with each other, namely by means of a welded connection.

It is preferred that in the area of the welded connection, the bearing shell has a distance to the bearing bush. A welded connection is a thermal connection, which involves the risk of a small deformation, particularly in connection with sheet metal shaped parts. This risk, however, can be readily accepted, when it is ensured that the welded connection and the immediately surrounding parts of the bearing shell have no direct contact with the bearing bush. Thus, the bearing shell and the bearing bush can maintain spherical shapes adapted to each other.

Preferably, an annular chamber is formed between the bearing shell and the bearing bush, in which annular chamber the longitudinal channel ends. This annular chamber can now be used for two purposes. Firstly, the annular chamber provides the distance to the bearing bush required for the welded connection.

Secondly, it is preferred that the annular chamber is connected with at least one through channel formed in the bearing bush, said channel being, during each rotation, connected at least once with an oil supply channel formed inside the crank pin. In this case, the annular chamber can be used as oil reservoir, which is, during each rotation of the crank pin, acted upon, once or several times, by a pulse-like oil supply. From this annular chamber, the oil can flow through the longitudinal channel of the connecting rod to the piston.

Preferably, the bearing bush and the bearing shell have a distortion protection. This distortion protection ensures that the alignment between the through channel and one or more openings in the wall of the crank pin always takes place in the correct position, so that the pulse-like oil supply always occurs at the right times, for example in the moment of the largest load of the individual articulated connections. The distortion protection can be made in a relatively simple manner. For example, an indent can be made in the bearing shell and a corresponding groove in the surface of the bearing bush. In this case, the bearing bush rotates on the crank pin and the bearing shell permits a swing movement between the connecting rod and the bearing bush.

It is also advantageous that on its frontside the crank pin has an oil outlet opening being connected with the oil supply channel, and the bearing shell has a screen in the area of the connecting rod. The oil outlet opening permits oil to escape and lubricate an area between the crank pin and the bearing bush. The oil escaping through the oil outlet opening is at the same time ejected in the form of a spray jet into the inside of a casing, in which the piston compressor is located. Here, the oil can be cooled, in that it can run down the inner wall casing, thus transferring heat to the outside. However, there is a risk that during such a cooling of the oil, oil will also get to the suction area of the piston compressor. The screen efficiently prevents this.

In a preferred embodiment, it is ensured that the bearing shell is made in one piece and mounted on the crank pin from above. This keeps the costs of the mounting low. In case that spherical bearing bush is used, the bearing shell can be bent or bordered towards the inside to provide a safe hold.

In an alternative embodiment it may be provided that the bearing shell is made with two parts, each of the two parts having a connection flange, the connection flanges being connected with each other on the radial outside. Also here, the connection can, for example, be made by means of welding. When the connection is made on the radial outside, deformations caused by thermal tensions are kept small, that is, the bearing shell maintains its shape, which is adapted to the bearing bush.

It is preferred that both connection flanges are bent in the same direction parallel to the axis of the crank pin and are welded together in the bent area. The bent areas do not have to be exactly parallel to the axis of the crank pin. However, they permit that a welding can be made in that corresponding welding equipment acts upon the bent area from the outside. This again is a relatively simple embodiment, which keeps the manufacturing costs low.

Preferably, the crank pin is made as a cup-shaped sheet metal shaped part, which is connected with the drive shaft. This keeps the manufacturing costs for the crankshaft small. Further, also here a certain weight is saved, as a crank pin in the form of a sheet metal shaped part usually has a smaller mass than a crank pin, which is moulded onto the drive shaft. In particular, a relatively small oil outlet opening can be made at relatively low costs, while the inside of the crank pin can anyway be provided with a relatively large oil supply chamber.

Preferably, the crank pin has a circumferential fixing flange. Thus, the crank pin is bent radially outwards at its open end. The flange formed in this way serves the purpose of fixing the crank pin on the drive shaft.

It is preferred that the bearing bush is axially supported on the fixing flange. Thus, the fixing flange does not only serve the purpose of connecting the crank pin with the drive shaft. It also supports the bearing bush, so that the bearing bush is only connected with one part. Accordingly, abutting joints, which could cause a larger wear on the bearing bush, are efficiently avoided.

In an alternative embodiment it is ensured that the bearing bush has a distance to the fixing flange. Thus, a friction between the bearing bush and the crank pin is kept small. The friction is limited to the circumferential surface of the crank pin.

Preferably, the bearing shell has a swing limitation in relation to the bearing bush. This is particularly advantageous, when the bearing bush has a distance to the fixing flange. In this case, there is namely a risk that the bearing bush is displaced too far. When the swing movement prevents such a displacement, the bearing bush remains in place on the crank pin.

It is also advantageous that a retaining ring is located between a frontside of the bearing bush and the bearing shell. During operation breaks, this retaining ring leads to resetting of the bearing bush in relation to the crank pin in such a manner that, when starting, the required orientation between the crank joint on the crank pin and the connecting rod joint on the piston is available.

Preferably, the drive shaft has on its frontside a fixing surface with a recess, in which the crank pin is fixed. This recess is, for example, deeper than the thickness of the fixing flange. The recess can be larger than the fixing flange of the crank pin. In this case, the crank pin can be positioned at different positions on the drive shaft. This permits the stroke length of the piston of different compressors to be set at different values.

Preferably, the piston-side end of the shaft is inserted in a ball, which forms part of a ball joint, by means of which the connecting rod is connected with the piston. The connecting rod is thus supported to be swinging in both ends, so that the position of the piston no longer has to be exactly in accordance with the position of the crank pin.

BRIEF DESCRIPTION OF THE DRAWINGS

In the following, the invention is described on the basis of preferred embodiments in connection with the drawings, showing.

DETAILED DESCRIPTION OF THE PREFERRED EMBODIMENTS

Figure 1:
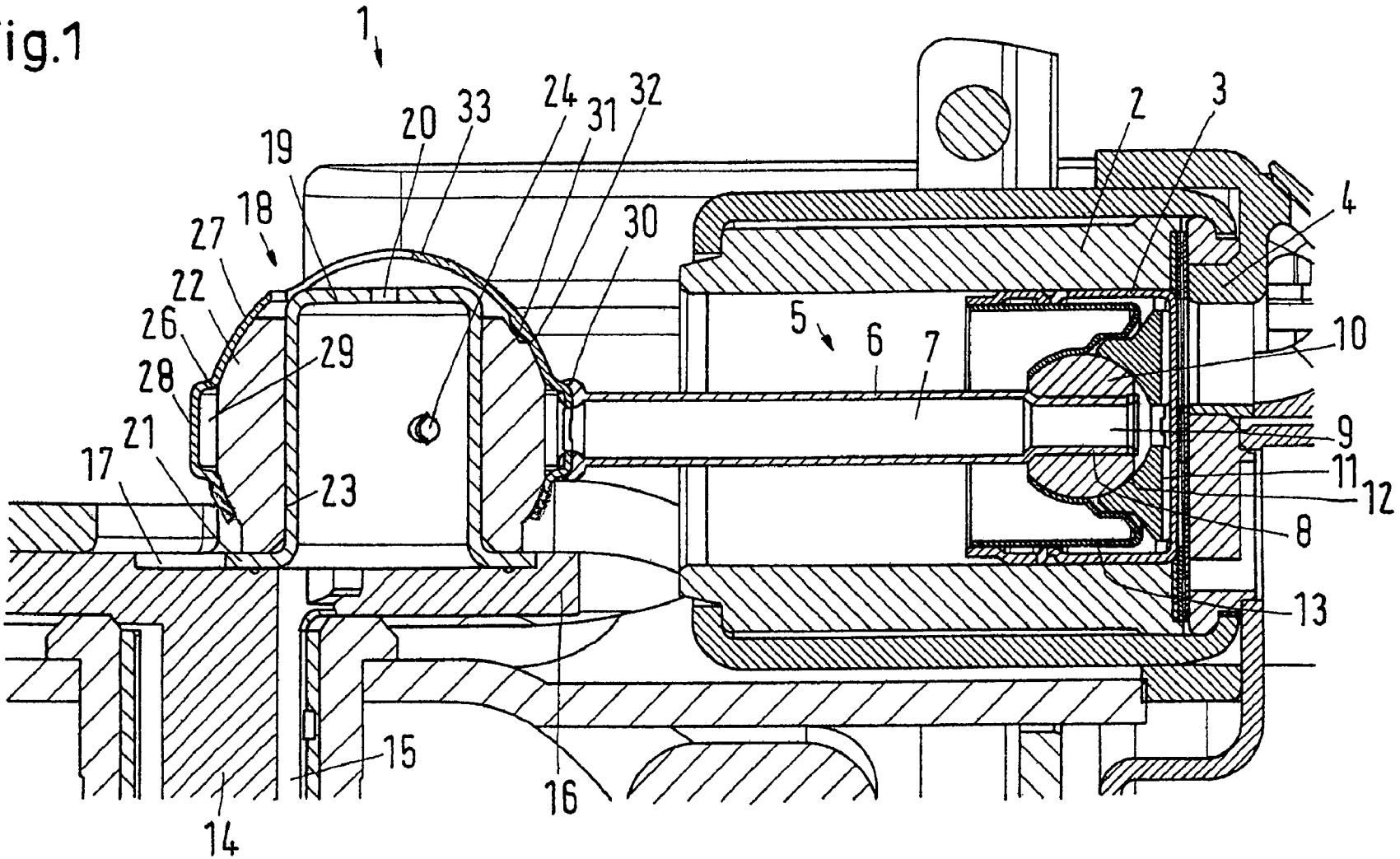
FIG. 1 is a sectional view through a part of piston compressor.

FIG. 1 shows a sectional view of a piston compressor 1. The piston compressor 1 has a cylinder 2, in which a piston 3 is arranged to be reciprocating. Via a cylinder head 4, only shown schematically, the piston 3 sucks refrigerant gas into a compression chamber during a suction stroke, and compresses this gas again during a pressure stroke. This procedure is known per se and will therefore not be explained in detail.

The movement of the piston 3 is controlled by a connecting rod 5. The connecting rod 5 has a shaft 6, which is formed as a sheet metal pipe. The sheet metal pipe may, for example, be made by drawing. It can be cut off from a semi-finished product. The sheet metal pipe surrounds a longitudinal channel 7. The diameter of the longitudinal channel 7 is substantially larger than the wall thickness of the sheet metal pipe, which forms the shaft 6. Accordingly, the shaft cannot only be manufactured in a cost-effective manner; it also has a low weight.

At the piston-side end, the shaft has a section 8 with a reduced diameter, which is inserted in a diameter bore 9 of a ball 10 and fixed there. The fixing can, for example, be made as a press fitting. However, the shaft 6 can also be connected with the ball 10 in other ways, for example by welding, gluing or by bulging the end of the shaft that projects through the ball 10.

The piston 3 is also made as a shaped sheet metal part. The ball 10 is supported in a reinforcement element 11, which forms a bearing surface 12, and is held in the piston 3 by means of a fixing element 13.

At the other end of the connecting rod 5 a drive shaft 14 is located. The drive shaft 14 has a substantially axially extending oil channel 15, which is connected with an oil pump in a manner not shown in detail but known per se, for example a centrifugal pump.

On its frontside, the drive shaft 14 has a fixing plate 16 with an eccentrically located recess 17, in which the oil channel 15 ends.

In the recess 17, a crank pin 18 is located. The crank pin 18 is also made of sheet metal. It has the shape of a turned-over cup, whose bottom 19 is provided with an oil outlet opening 20. At the end opposite its bottom 19, the crank pin 18 has an outwardly bordered fixing flange 21, with which the crank pin 18 is fixed on the fixing plate 16 in the recess 17. In this connection the recess 17 has a depth, which corresponds to or is larger than the thickness of the fixing flange 21. The end of the fixing flange 21 therefore flushes with the surface of the fixing plate 16, or it is somewhat countersunk into the fixing plate 16. The oil channel 15 is located so that it ends inside the crank pin 18. Depending on the desired stroke length of the piston 3, the crank pin 18 can be mounted in different positions within the recess 17. For mounting, the crank pin 18 is welded or glued with the fixing flange 21 onto the fixing plate 16.

Fitted on the crank pin is a bearing bush 22, which can, for example, be made of a sintered metal. The bearing bush has an inner bore 23, which is exactly as large as the outer diameter of the crank pin 18. It is arranged to be rotatable in relation to the crank pin 18.

On its bottom side, the bearing bush 22 is supported on the fixing flange 21, which here has a larger diameter than the diameter of the bearing bush 22. Accordingly, the bearing bush does not have to overcome any parting lines during a rotational movement, which keeps the wear small.

The bearing bush 22 has at least one through channel, which comes to overlap an opening 24 in the circumferential wall of the crank pin 18 during certain sections of a rotational movement. Of course more than one through channel and more than the one opening 24 shown can be provided.

On the end facing the crank pin 18, the connecting rod 5 has a bearing shell 16, which is, according to the embodiment in FIG. 1, made in one piece. The bearing shell 26 has a spherical section 27, whose radius is adapted to the radius of the bearing bush 22, which is also made to be spherical in two annular areas. In its lower area, the bearing shell 26 is bent inwards or bordered, said inward shaping also substantially following the spherical shape of the bearing bush. Accordingly, it is possible that in a limited angle area the bearing shell 26 performs small swing movements in relation to the bearing bush. This has the advantageous effect that the shaft 6 of the connecting rod 5 no longer has to extend in an angle of exactly 90° in relation to the rotation axis of the drive shaft 14.

Through a diameter expansion 28, the bearing shell 26 forms an annular chamber 29 with the bearing bush 22, said chamber 29 being connected with the inside of the crank pin 18 via the through channel and the opening 24. During operation, a certain pressurised oil reservoir is held available in this annular chamber 29. The annular chamber 29 is connected with the longitudinal channel 7 in the shaft 6 of the connecting rod 5.

The shaft 6 is welded onto the bearing shall 26 at a connection point 30. This connection point 30 is located in the area of the diameter expansion 28. Thus, deformations of the bearing shell 26, which may occur during the welding, are kept away from the bearing bush 22. The welding can be made as a resistance welding. An alternative is that the pipe, which forms the shaft 6, is simply cut off bluntly and then connected with its frontside to the bearing shell 26 by means of friction welding.

The bearing shell 26 has an indent 31, which projects into a groove 32 on the surface of the bearing bush 22. Together with the groove 32, the indent 31 forms a distortion protection between the bearing shell 26 and the bearing bush 22, which permits a swing movement (in the drawing level), but prevents a distortion.

The bearing shell 26 further has a screen 33, which prevents oil, which is ejected through the oil outlet opening 20 in the crank pin 18, from penetrating immediately into the area of the cylinder head 4. Thus, it is prevented that oil can reach the suction area of the compressor, where it could be mixed with the suction gas.

During operation, when the drive shaft 14 rotates, oil is pumped through the oil channel 15 into the inside of the crank pin 18. A share of the oil is ejected upwards through the oil outlet opening 20 and reaches the inner wall of a casing, not shown in detail. Here, it can run down, while giving off its heat to the casing and thus to the surroundings.

A further share of the oil gets through the opening 24 in the wall of the crank pin 18 and the through channel, which is periodically overlapping the opening 24, into the annular chamber 29, and from here it continues pulsatingly into the longitudinal channel 7 in the shaft 6. The pressurised oil supplied here is used for lubricating the ball joint in the piston 3. Further, this oil can flow through the piston 3 and contribute to a cooling.

Figure 2:
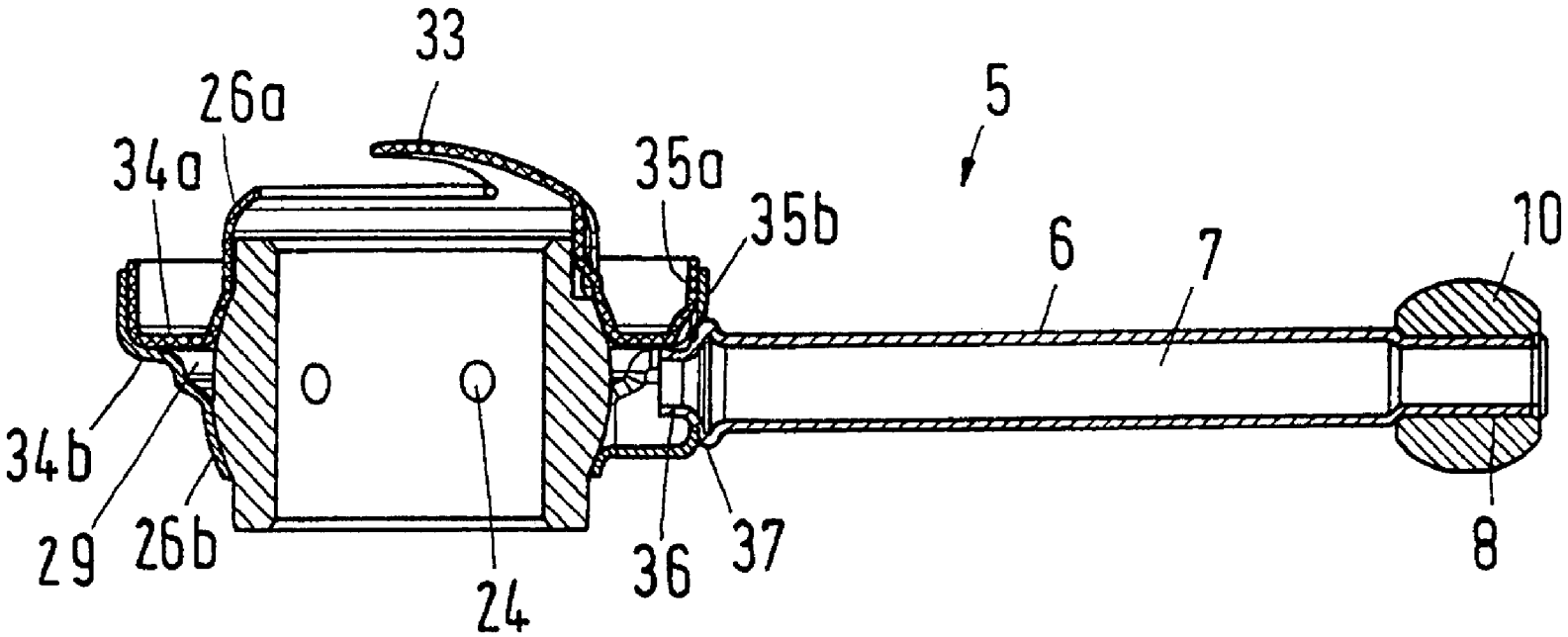
FIG. 2 is a modified form of a connecting rod.

FIG. 2 shows a modified embodiment, in which the same and similar parts have the same reference numbers.

Whereas in the embodiment according to FIG. 1, the bearing shell 26 had been made in one piece and mounted on the bearing bush 22 from above, being held by a bordering on the bearing bush 22, the bearing shell according to the embodiment in FIG. 2 is formed of two parts 26*a*, 26*b*, which surround the bearing bush 22 so that here a form fitting occurs. Both parts 26*a*, 26*b* have a fixing flange 34*a*, 34*b*. On their radial outer areas, the two fixing flanges 34*a*, 34*b* are bent outwards. In these sections 35*a*, 35*b*, the fixing flanges are welded together.

At the end facing the crank pin 18, the shaft 6 has a further diameter reduction 36, which extends into the shaft 6 via an upsetting area 37. The upsetting area 37 is connected with the bearing shell, for example by means of resistance welding.

Considerable advantages can be achieved with the embodiments shown.

Firstly, the use of a sheet metal pipe for the shaft 6 makes the manufacturing cheaper. The shaft 6 can simply be cut off in the required length from a semi-manufactured pipe, and then be connected with the bearing shell 26 or the ball 10, respectively. An adaptation to different compressors is easily possible, when different lengths are chosen for the shaft 6.

Due to the small weight, the operation behaviour of a compressor equipped with such a connecting rod is substantially more favourable. Vibrations are less, due to the smaller mass to be moved. The oil supply through the connecting rod to the piston remains. Due to the ball joint bearing at both ends of the connecting rod 5, tilting of the piston and the crank pin bearing is avoided.

Figure 3:
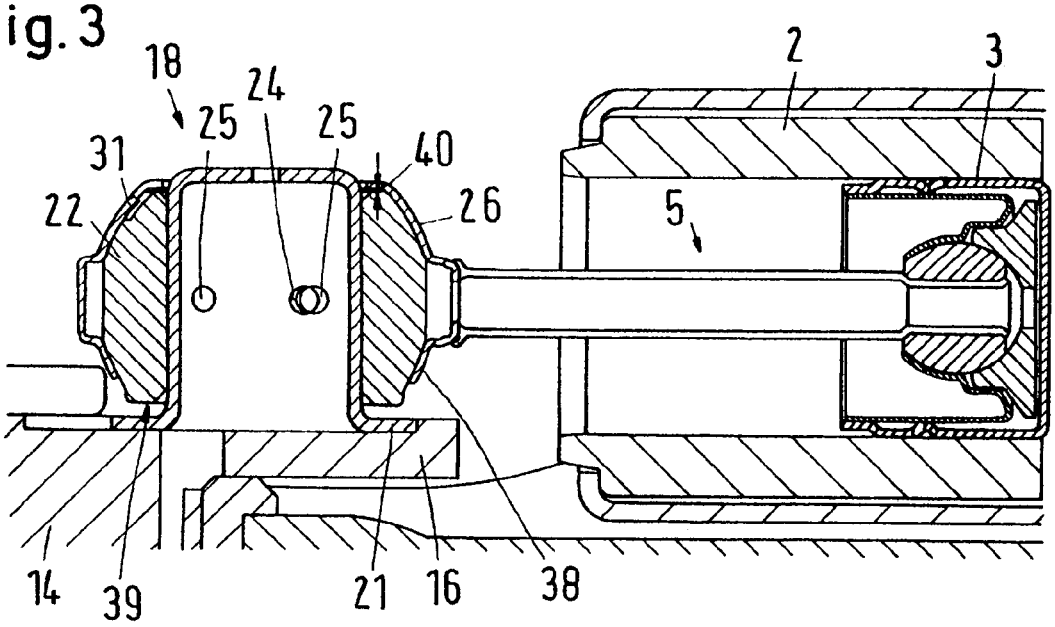
FIG. 3 is a schematic view of a modified form of a piston compressor.

FIG. 3 shows a modified embodiment of a piston compressor, in which the same parts have the same reference numbers as in FIG. 1. However, the piston compressor is shown with fewer details.

In this embodiment, the bearing shell 26 is again made in one piece. In its lower area, the bearing shell 26 has a bordering 38, so that it is held to be form fitting on the bearing bush 22.

Contrary to the embodiment according to FIG. 1, a distance 39 is provided between the bearing bush 22 and the flange 21 of the crank pin 18, so that the bearing bush 22 only rubs on the circumferential surface of the crank pin 18, not, however on its frontside, when the crankshaft 14 rotates.

In order to avoid, with this embodiment, a too extensive sinking of the bearing bush on the crank pin 18, a gap 40 is provided between the bearing shell 26 and the bearing bush 22 on the frontside of the bearing bush 22, said gap 40 permitting only to a certain degree a swing movement between the bearing bush 22 and the bearing shell 26, thus limiting a swing movement exceeding this. Thus, the bearing shell 26 engages the bearing bush 22 so that during a swing movement the bearing shell 26 comes to rest on the bearing bush 22.

Also shown is a through channel 25, which has, in the position according to FIG. 3, reached an overlapping with an opening 24 in the circumferential wall of the crank pin 18.

Figure 4:
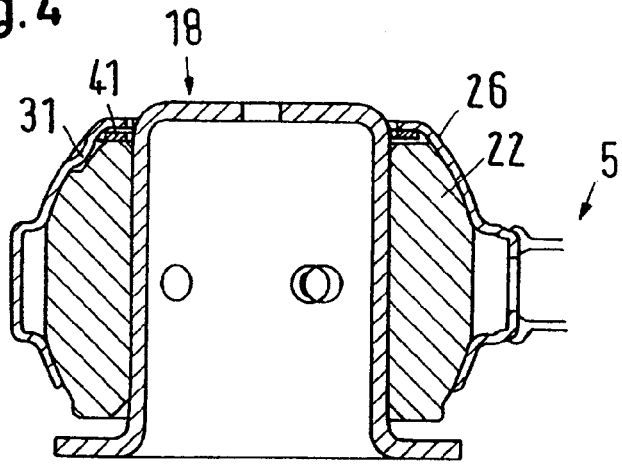
FIG. 4 is a further modification of a crank joint on the crank pin.

FIG. 4 shows a further modified embodiment, in which the same parts have the same reference numbers as in FIG. 3. On the frontside of the bearing bush 22 is provided a spring washer 41, for example in the form of a retaining ring. The bearing shell 26 is supported on this spring washer 41. Also the spring washer 41 causes a swing limitation of the connecting rod 5 in relation to the crank pin 18. Further, it acts resetting, that is, without adding further outer forces, the spring washer 41 aligns the bearing bush 22 on the crank pin 18 in such a manner that it always has the right position on the crank pin 18. A swing movement is permissible within certain limits. These limits have been chosen so that an undisturbed driving of the piston 3 in the cylinder 2 is ensured.

Figure 5:
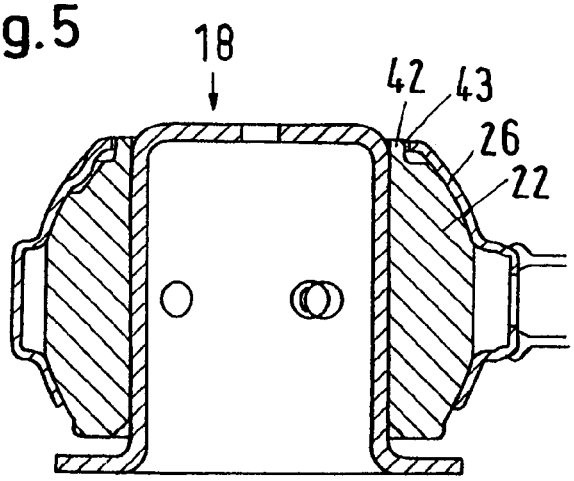
FIG. 5 is a further modification of a crank joint on the crank pin.

FIG. 5 shows a further modified embodiment, in which the same parts have the same reference numbers as in FIGS. 3 and 4. Here, the swing limitation exists in that the bearing bush 22 has an extension 42 in the axial direction of the crank pin 18, said extension 42 forming a gap 43 with the bearing shell 26. This gap 43 acts almost like the gap 40 in the embodiment according to FIG. 3, that is, it permits a swing movement between the bearing shell 26 and the bearing bush 22 until the bearing shell 26 hits the extension 42.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A piston compressor comprising: a piston, which is connected to a crank pin of a drive shaft via a connecting rod having a shaft and a longitudinal channel adapted to allow oil to flow from the crank pin to the piston, wherein the shaft of the connecting rod is made as a sheet metal pipe and the sheet metal pipe forms the longitudinal channel.

2. The piston compressor according to claim 1, wherein the crank pin has a bearing bush, which has, at least in sections, a spherical outer surface.

3. The piston compressor according to claim 2, wherein the shaft is connected with an at least partially spherical bearing shell, which surrounds the bearing bush.

4. The piston compressor according to claim 3, wherein the shaft is welded onto the bearing shell.

5. The piston compressor according to claim 4, wherein in the area of the welded connection, the bearing shell has a distance to the bearing bush.

6. The piston compressor according to claim 3, wherein an annular chamber is formed between the bearing shell and the bearing bush, in which annular chamber the longitudinal channel ends.

7. The piston compressor according to claim 6, wherein the annular chamber is connected with at least one through channel formed in the bearing bush, said channel being, during each rotation of the drive shaft, connected at least once with an oil supply channel formed inside the crank pin.

8. The piston compressor according to claimed 7, wherein the bearing bush and the bearing shell have a distortion protection.

9. The piston compressor according to claim 7, wherein on its frontside the crank pin has an oil outlet opening being connected with the oil supply channel, and the bearing shell has a screen in the area of the connecting rod.

10. The piston compressor according to claim 3, wherein the bearing shell is made in one piece and mounted on the crank pin from above.

11. The piston compressor according to claim 3, wherein the bearing shell is made with two parts, each of the two parts having a connection flange, the connection flanges being connected with each other on the radial outside.

12. The piston compressor according to claim 11, wherein both connection flanges are bent in the same direction parallel to the axis of the crank pin and are welded together in the bent area.

13. The piston compressor according to claim 1, wherein the crank pin is made as a cup-shaped sheet metal shaped part, which is connected with the drive shaft.

14. The piston compressor according to claim 13, wherein the crank pin has a circumferential fixing flange.

15. The piston compressor according to claim 14, wherein the bearing bush is axially supported on the fixing flange.

16. The piston compressor according to claim 14, wherein the bearing bush has a distance to the fixing flange.

17. The piston compressor according to claim 16, wherein the bearing shell has a swing limitation in relation to the bearing bush.

18. The piston compressor according to claim 16, wherein a retaining ring is located between a frontside of the bearing bush and the bearing shell.

19. The piston compressor according to claim 13, wherein the drive shaft has on its frontside a fixing surface with a recess, in which the crank pin is fixed.

20. The piston compressor according to claim 1, wherein the piston-side end of the shaft is inserted in a ball, which forms part of a ball joint, by means of which the connecting rod is connected with the piston.

21. A piston compressor comprising: a piston, which is connected to a crank pin of a drive shaft via a connecting rod having a shaft and a longitudinal channel, wherein the shaft of the connecting rod is made as a sheet metal pipe, wherein the crank pin has a bearing bush, which has, at least in sections, a spherical outer surface, wherein the shaft is connected with an at least partially spherical bearing shell, which surrounds the bearing bush, and wherein the shaft is welded onto the bearing shell.

22. The piston compressor according to claim 21, wherein in the area of the welded connection, the bearing shell has a distance to the bearing bush.

23. A piston compressor comprising: a piston, which is connected to a crank pin of a drive shaft via a connecting rod having a shaft and a longitudinal channel, wherein the shaft of the connecting rod is made as a sheet metal pipe and wherein the crank pin is made as a cup-shaped sheet metal shaped part, which is connected with the drive shaft.

24. The piston compressor according to claim 23, wherein the crank pin has a circumferential fixing flange.

25. The piston compressor according to claim 24, wherein the bearing bush is axially supported on the fixing flange.

26. The piston compressor according to claim 24, wherein the bearing bush has a distance to the fixing flange.

27. The piston compressor according to claim 23, wherein the drive shaft has on its frontside a fixing surface with a recess, in which the crank pin is fixed.

* * * * *